United States Patent [19]

Schwarz

[11] 4,012,856

[45] Mar. 22, 1977

[54] GRAB OR GRAB BUCKET AND METHOD OF OPERATING SAME

[75] Inventor: Wilhelm Schwarz, Wilhelmshaven, Germany

[73] Assignee: Fried. Krupp Gesellschaft mit beschrankter Haftung, Essen, Germany

[22] Filed: Mar. 26, 1975

[21] Appl. No.: 562,234

[30] Foreign Application Priority Data

Apr. 1, 1974 Germany ..... 2415664

[52] U.S. Cl. ..... 37/187; 37/DIG. 18; 214/147 R

[51] Int. Cl.[2] ..... B66C 3/02

[58] Field of Search ..... 37/DIG. 18, 183 R, 186, 37/187, 188; 214/147 G, 147 R, 14, 145, 656, 657, 152

[56] References Cited

UNITED STATES PATENTS

| | | | |
|---|---|---|---|
| 1,812,926 | 7/1931 | Buckland | 37/DIG. 18 |
| 2,152,220 | 3/1939 | Solomon | 37/187 X |
| 2,736,444 | 2/1956 | Smith | 214/657 |
| 2,850,815 | 9/1958 | Edwards | 37/DIG. 18 |
| 3,030,715 | 4/1962 | Bodine | 214/145 X |
| 3,606,036 | 9/1971 | Beebe et al. | 214/14 |
| 3,828,951 | 8/1974 | Fleming | 37/DIG. 18 |
| 3,896,952 | 7/1975 | Yokota et al. | 37/187 |

FOREIGN PATENTS OR APPLICATIONS

| | | | |
|---|---|---|---|
| 1,241,963 | 6/1967 | Germany | 37/183 R |
| 332,126 | 3/1919 | Germany | 37/186 |
| 3,112 | 3/1885 | United Kingdom | 37/183 A |

*Primary Examiner*—E. H. Eickholt
*Attorney, Agent, or Firm*—Walter Becker

[57] ABSTRACT

A grab bucket for pourable material and a method of operating the same, according to which during the closing of the grab bucket, at least one of the two grab bucket sections is at its closing edge subjected to oscillations with amplitudes in the direction toward the closing movement. The grab bucket has at least one of the two grab bucket sections provided with an oscillation starter.

8 Claims, 7 Drawing Figures

FIG. 2
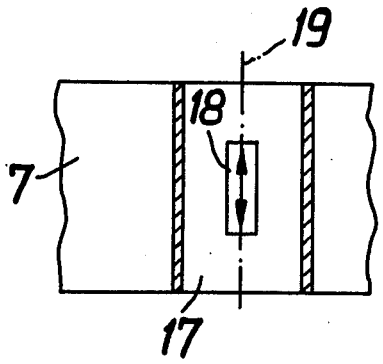
FIG. 3
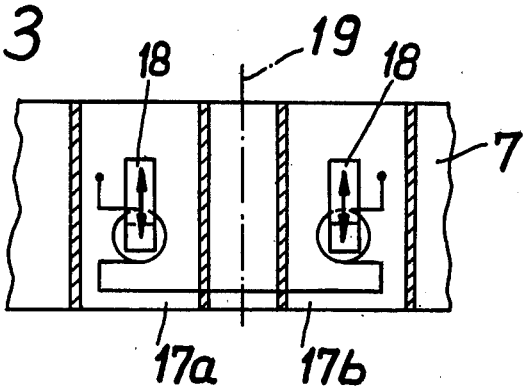
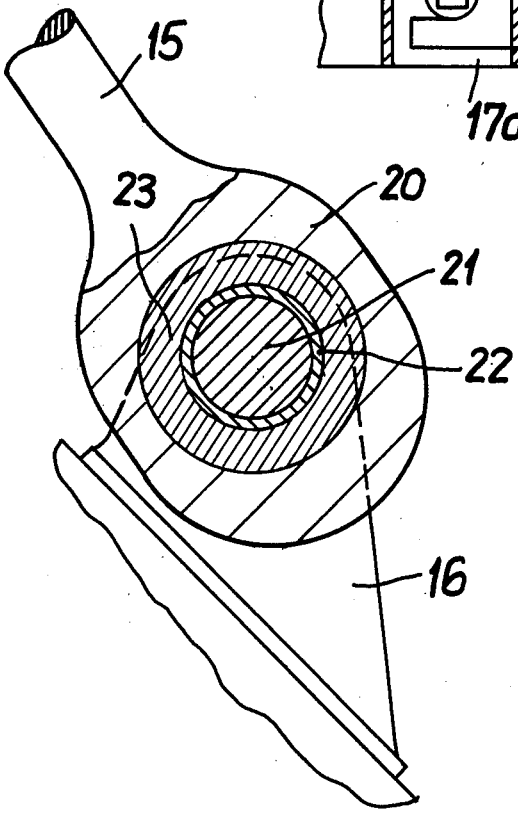
FIG. 4

GRAB OR GRAB BUCKET AND METHOD OF OPERATING SAME

The present invention relates to a grab or grab bucket for transloading pourable materials. Such a device heretofore had the drawback that it caused a considerable development of dust which should be avoided in conformity with modern ecology and protection of the environment. For purposes of picking up the pourable goods, it is customary that the crane conductor drops the open grab bucket onto the material to be transloaded. This is usually effected at a high speed in order to obtain a sufficient entry of the bucket teeth or edges. Due to the impact of the grab or grab bucket onto the pourable material, dust is raised. Since further dust development is brought about when the grab or grab bucket does not completely close because material gets stuck between the cutting edges of the grab bucket, during the lifting and tilting movement of the grab bucket fine granular particles trickle out of the same. This may occur with grab buckets or grabs operated by closing cables as well as with grabs or grab buckets operated electrically or hydraulically. With a hydraulic closing mechanism the above drawback occurs because the closing forces for reasons of strength must not exceed a certain force. The same applies to manually operable one-cable operated grabs or grab buckets. Also, after the grab bucket has been emptied, dust development and soiling is possible because residues remain in the corners of the grab or grab bucket so that these residues drop out during the movement of the open grab or grab bucket. This is the case above all with grabs having a motor-driven closing mechanism which less than a grab bucket with closing cables furnishes the possibility of causing the residues from the opened grab bucket to drop out by shaking the grab bucket before the grab bucket has left its position above the bunker.

It is, therefore, an object of the present invention to provide a grab or grab bucket and method of operating same in such a way that the above outlined drawbacks will be obviated.

This object and other objects and advantages of the invention will appear more clearly from the following specification, in connection with the accompanying drawings, in which:

FIG. 1 is a diagrammatic side view of a closing cable operated grab bucket in closing condition.

FIG. 1*a* shows the same grab bucket in open position.

FIG. 2 illustrates on a larger scale than FIG. 1 a portion of one embodiment of the invention as seen in the direction of the arrow A of FIG. 1.

FIG. 3 shows a cutout similar to that of FIG. 2, but of a different embodiment of the invention.

FIG. 4 illustrates partially in section a detail of the arrangement of FIG. 1 at B, but on a larger scale than that of FIG. 1.

The method of operating a grab bucket according to the present invention is characterized primarily in that when closing the grab bucket at least one of the two grab bucket sections are at their closing edges caused to carry out oscillations with amplitudes in the direction of the closing movement. The grab bucket according to the invention which is provided with two bucket sections adapted by pivoting them toward and away from each other to be moved into closing and opening position, is characterized primarily in that at least one of the two bucket sections is provided with an oscillation starter.

Figure 1:
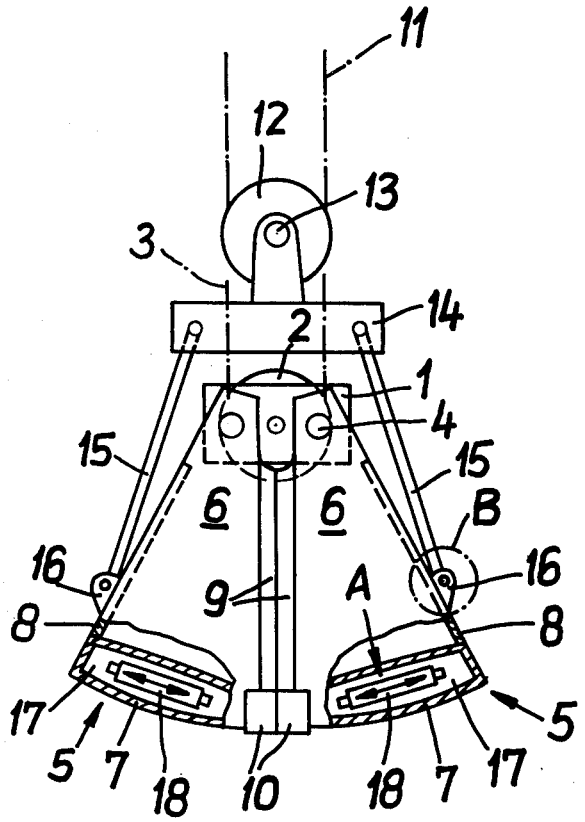

Referring now to the drawings in detail, the head 1 of the grab bucket shown in FIG. 1 has mounted thereon the lower cable rollers for the closing cables 3. By means of joint bolts 4, the two bucket sections 5 are mounted on the head 1. The interior of each bucket section 5 is on both sides confined by lateral walls 6, and by a curved sheet 7 on that side which faces the joint bolt 4, and by a sheet 8 at the back. The edges of the openings of bucket sections 5 which openings face each other are provided with strips 9 which are mounted on the side wall 6 and are furthermore provided with strips 10 which are mounted on the curved sheets 7. When the grab bucket is in its closed position, the strips 9, 10 of the two bucket sections 5 are in the ideal case engaging each other closely so that no pourable material can escape from the grab bucket. This is also the case when the strips 10 are equipped with teeth offset relative to each other.

Figure 1A:
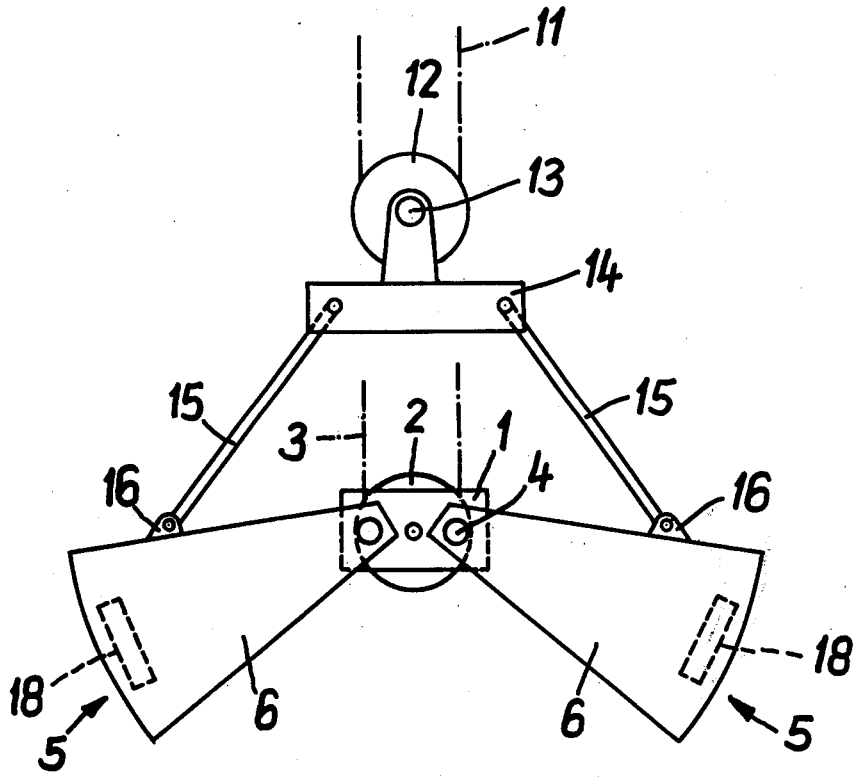
Figure 5:
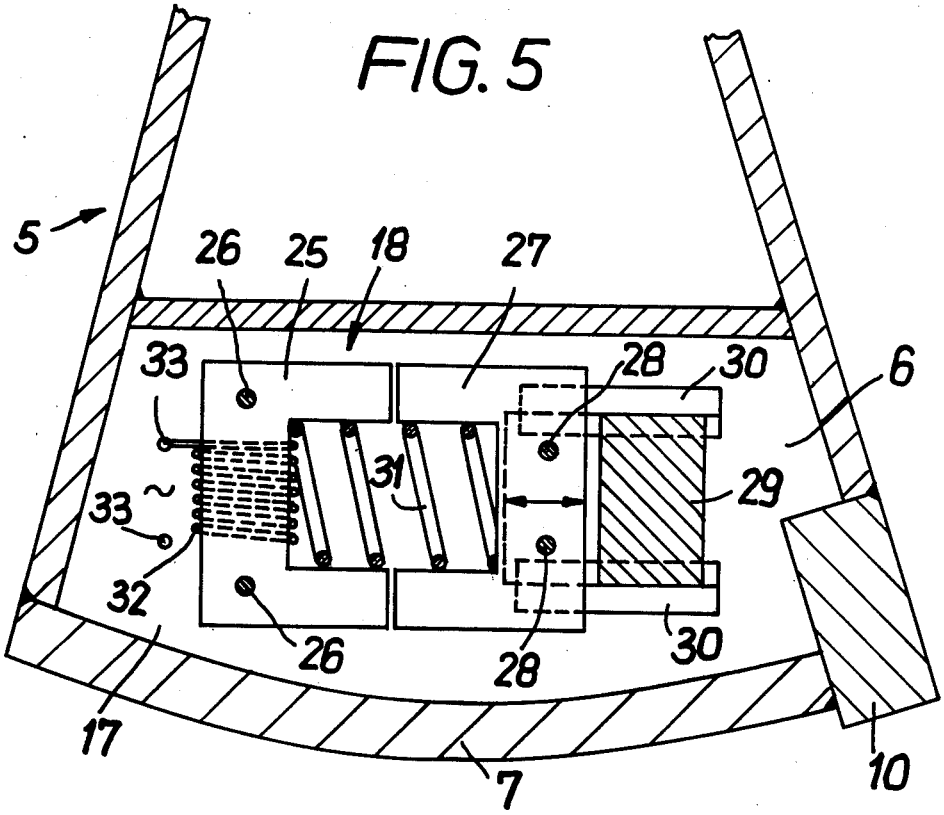
FIG. 5 shows a section through the lower part of a grab bucket portion with electromagnetically operated means for exciting oscillations, said section being taken along a vertical plane to which the axis of rotation of the grab bucket is perpendicular.
Figure 6:
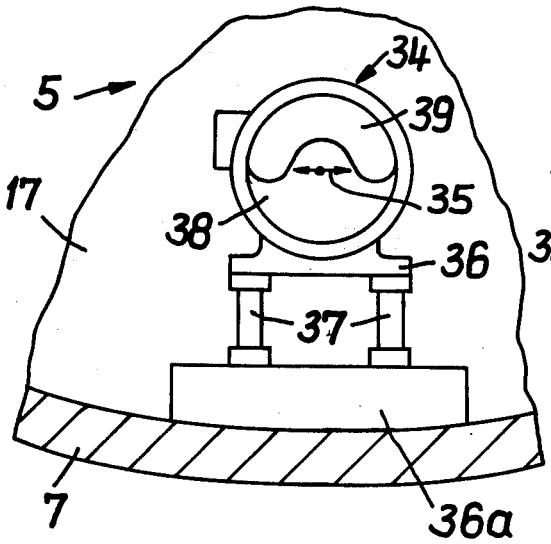
FIG. 6 shows a section through a lower portion of a grab bucket with an oscillation exciter equipped with an unbalance, said section being taken in a manner corresponding to that of FIG. 5.
Figure 7:
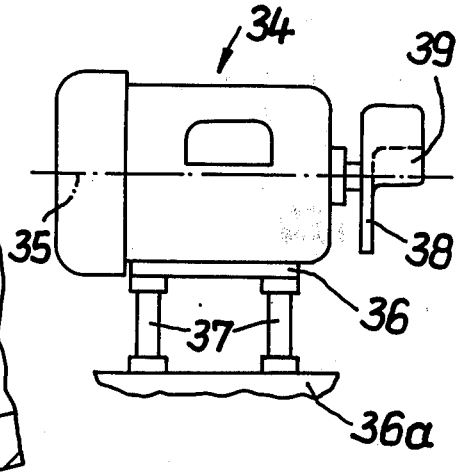
FIG. 7 is a side view of the oscillation exciter.

For purposes of opening the grab bucket, there is provided a discharging cable 11 which is operable by a separate winch independently of the closing cable 3. The discharging cable 11 is passed around a lower cable pulley 12, the axle 13 of which, has a yoke 14 suspended thereon. The two ends of the yoke 14 are by means of rods 15 connected to eyes 16 provided on the back of the grab bucket sections 5. When the grab bucket is to be opened, the yoke 14 will be lifted by means of the discharging cable 11, whereas the head 1 does not change its position as to height. Consequently, the bucket sections 5 are by means of the rods 15 pivoted into their opening positions in conformity with FIG. 1a. Each of the two bucket sections 5 has according to the embodiment shown in FIG. 2, a bottom pocket 17 which is closed toward the outside by the curved sheet 7. Within said pocket 17 there is provided an oscillation starter or vibration means 18 of any known design. This oscillation starter 18 is so arranged that the oscillation amplitudes have their grab bucket blades directed toward the strips 10 and alternately away from the latter, as shown in FIG. 1 by arrows. Thus, for instance, mass oscillators are provided which are operated electromagnetically. Such oscillation starter is shown, for instance, in FIG. 5. Within the pocket 17 on the side walls 6 of the grab bucket section 5 a C-shaped magnetic armature 25 is connected by means of screw bolts 26, said armature 25 being composed of sheet metal discs or lamellae. As an image to said armature 25 there is provided a further C-shaped magnetic armature 27 which is so arranged that gaps are provided between those ends of the legs of the two magnetic armatures 25, 27 which face each other. The magnetic armature 27 is by means of screw bolt 28 fixedly connected to a body 29 extending on both sides around said armature 27. This body 29 is by means of strips 30 arranged on the side walls 6 of the grab bucket section 5 so guided that it can to a certain extent be moved back and forth in the direction of the oscillation movements which in FIG. 1 are indicated by arrows on the oscillation exciters 18. In this space enclosed by the two C-shaped magnetic armatures 25, 27 there is provided a helical pressure spring 31 which tends to move the magnetic armature 27 in the direction away from the magnetic armature 25 to an abutment. The yoke of the magnetic armature 25 is surrounded by an excitation coil 32 which by means of terminals 33 is connected to a nonillustrated source of alternating voltage. The masses of the magnetic armature 25 and of the grab bucket section 5 on one hand, and the masses of the magnetic armature 27 and of the body 29 on the other hand form swinging masses together with the helical pressure spring 31 in an oscillation system, the frequency of which, depends on the magnitude of the said masses and the spring characteristics of said spring 31 and is twice as high as the frequency of the alternating current which passes through the coil 32. The grab bucket section 5 carries out corresponding oscillating movements. However, for instance, also oscillation starters with circulating unbalances of any known design may be employed. Such oscillation starter is shown in FIGS. 6 and 7. Within the pocket 17 of a grab bucket section 5 an electric motor 34 is so mounted that its axis of rotation 35 is parallel to the axes of the joint bolt 4. The foot plate 36 of the electric motor 34 rests on a support 35*a* by means of four legs 37 of rubber as spring means. These legs 37 are yieldable, preferably in the desired direction of oscillation which is indicated in FIG. 6 by a double arrow. Mounted on the shaft of the electric motor 34 is a disc 38 which comprises a thickened portion 39 that is offset relative to the axis of rotation of the electric motor 34. This portion 39 forms the unbalancing mass. The frequency of the oscillation exciting means corresponds to the speed of the electric motor 34. The oscillation starters 18 are protected against damage during the operation of the grab bucket, for instance, by correspondingly strong sheets 7.

When during the closing operation particles get jammed or clamped in between the strips 10, for instance, elements of coarse-grained material or compacted fine-grained or dust-like material, without the invention provided between the plates or strips 10, a gap would be formed through which fine-grained or dust-like components of the material would escape from the grab bucket so that these materials would during the pivoting of the grab bucket be dispersed over the ground or blown away by the wind. According to the present invention, however, during the closing operation of the grab bucket sections, the oscillation starter becomes effective. As a result thereof, the bucket sections 5 are subjected to oscillations which bring about that particles between the strips 10 will not hold onto the strips or the bucket sections or will be smashed so that the strips 10 as well as the strips 9 will closely engage each other.

According to FIG. 2, the chamber 17 of each bucket section 5 is located centrally with regard to the vertical central plane 19 of bucket section 5, which central plane 19 extends in parallel with regard to the side walls 6.

According to FIG. 3, on the other hand each bucket section 5 comprises two pockets 17*a*, 17*b*, which are symmetrically arranged with regard to the plane 19 and each of which comprises an oscillation starter 18. In this connection, springs of the same force constant for both oscillation starters and the same oscillation anchor masses are provided in the same arrangement so that the starter forces of both oscillation starters add up algebraically. This requires that the magnetic devices of both oscillation starters are synchronized so that the oscillations generated by the two oscillation starters 18 have no phase displacements relative to each other. Expediently, the synchronization is brought about by an electric series arrangement of the exciter coils pertaining to the two oscillation starters. On the other hand, a synchronous oscillation of the oscillation starters or oscillation starter groups provided in the two bucket sections 5 will be avoided. It will be appreciated that the two bucket sections 5 must not simultaneously swing in one direction and back toward the opposite direction. A removal of particles between the bucket edges is realized only when the edges of the bucket sections carry out oscillating movements relative to each other. Therefore, the oscillation starters pertaining to the two bucket sections are so dimensioned and operated that the frequencies of the oscillations of the two bucket sections are different from each other. For instance, it is desired that the oscillation frequency for one of the two bucket sections is greater or less by 20% than the oscillation frequency for the other bucket section. Consequently, the gap between the bucket edges varies in conformity with the oscillations which are due to a superimposition of the oscillations of the two bucket sections. Since, thus, the bucket edges oscillate toward each other and away from each other, no particles can accumulate in the variable gap between said edges.

It is, of course, possible that each bucket section 5 comprises more than two pockets with oscillation starters 18. When the grab bucket is closed, the oscillation starters 18 are turned off. They are turned on again after the bucket has been emptied above a bunker or above a conveyor. Due to the oscillations to which the bucket sections 5 occupying their open position will be subjected, residues of pourable material which got stuck in the bucket sections will be loosened so that they can drop into the bunker, or the like, prior to the grab bucket having left its position above said bunker.

When employing a two-cable grab bucket according to the described embodiment, expendiently care will be taken that the oscillations of the grab bucket sections are not conveyed to the yoke 14 and cables 11 through rods 15. To this end, the bucket rods 15 are connected to the eyes 16 of bucket sections 5 through the intervention of an oscillation damping intermediate member. According to FIG. 4, an eye 20 of a rod 15 extends with great play around a joint bolt 21 which extends through the bores of eyes 16 and carries a sleeve 22. The space between sleeve 22 and the inner surface of the bore is filled by an intermediate member 23, for instance, of rubber or an elastic synthetic material. It is also possible that without employing such intermediate member, a play of the magnitude of the oscillation amplitudes to be expected between the eye 20 of rod 15 and the joint bolt 21 is provided. When employing the invention, it is additionally possible that the opened grab bucket, for grasping the pourable material, is set down upon the pile of pourable material at an only low speed so that the development of dust will be avoided which occurred heretofore in view of the great force occurring at the impact of the grab bucket upon the pourable material. Due to the oscillations occurring during the closing movement of the grab bucket sections, the grab bucket edges or teeth provided thereon easily enter the pile of pourable material without the grab bucket edges or teeth having previously by a strong impact upon the pile of pourable material been caused to enter said pile. Furthermore, the closing forces to be applied will be reduced.

As will be evident from the above, the present invention brings about the advance that when closing the grab bucket sections, possible particles which happen to enter between the edges of the grab bucket sections will be removed by the oscillations of the grab buckets so that a proper closing of the grab bucket will be assured. Any residuals of said particles which should get stuck in the grab bucket can be removed therefrom above the bunker.

Adjusting members 15, respectively are pivotally connected to oscillate the bucket sections 5 with a play corresponding to the oscillation amplitudes, and yoke means 14 operatively connected to the adjusting members are provided for actuating the latter.

Adjusting members or rods 15 and joint means or hinges 20, 22 pivotally connecting the adjusting members 15 to said bucket sections 5 are oscillated thereby and the adjusting members also include means for dampening excessive oscillations (rubber legs 37).

It is, of course, to be understood that the present invention is, by no means, limited to the specific showing in the drawings, but also comprises any modifications within the scope of the appended claims.

What I claim is:

1. A method of actuating a grab bucket with two grab bucket sections for pourable material by use of plural vibrators recessed in the bottom of the bucket, which includes the steps of: during the closing of said bucket sections subjecting at least one of said two bucket sections at the closing edges thereof to vibrator oscillations with the amplitudes thereof directed in the direction of the closing movement of at least said one bucket section.

2. A method according to claim 1, which includes the step of during the closing of said bucket sections respectively subjecting both of said bucket sections at the closing edges thereof to vibrator oscillations of different frequencies.

3. A method according to claim 1, which includes the step of following the emptying of said grab bucket subjecting at least one of said bucket sections to vibrator oscillations.

4. A grab bucket in combination for pourable material with two bucket sections having openings facing each other and having bottom pockets, said bucket sections being pivotable toward and away from each other, strips provided in such arrangement that they can engage each other closely at the bucket openings facing each other, vibration means including swinging masses being included in at least one of said bucket sections in the bottom pocket as well as spring means and mass of said at least one bucket section and of additional portions fixed thereto collectively forming an oscillation system in such arrangement that the direction of oscillation independently of the opening angle of the bucket extends in the direction of the closing movement of said bucket section.

5. A grab bucket in combination according to claim 4, which includes rods with upper and lower ends, a yoke connected to said upper ends and which for opening the bucket can be lifted independently of the upper ends of said bucket sections and hinges including play therewith by which the lower ends of said rods are pivotably connected to said bucket sections.

6. A grab bucket in combination according to claim 5, in which said hinges have an intermediate clamping member therewith within said play.

7. A grab bucket in combination according to claim 4, in which at least one of said two bucket sections has associated therewith at least two means for exciting oscillations and means are provided for synchronizing these means for exciting oscillations.

8. A grab bucket in combination according to claim 4, in which each of said two bucket sections has associated therewith at least one means for exciting and means are provided for preventing resonance of these two bucket sections.

* * * * *